US010307628B2

(12) United States Patent
Tseng et al.

(10) Patent No.: US 10,307,628 B2
(45) Date of Patent: Jun. 4, 2019

(54) TRAMPOLINE WITH HANGING SEAT UNITS THAT ALLOWS ELASTIC ROPES TO BE MOUNTED EASILY

(71) Applicants: XIAMEN DMASTER HEALTH TECH CO., LTD., Xiamen (CN); Ching Tseng, Xiamen (CN)

(72) Inventors: Kevin Tseng, Xiamen (CN); Ching Tseng, Xiamen (CN)

(73) Assignees: Xiamen Dmaster Health Tech Co., Ltd., Xiamen (CN); Ching Tseng, Xiamen (CN)

( * ) Notice: Subject to any disclaimer, the term of this patent is extended or adjusted under 35 U.S.C. 154(b) by 136 days.

(21) Appl. No.: 15/689,774

(22) Filed: Aug. 29, 2017

(65) Prior Publication Data

US 2018/0353789 A1 Dec. 13, 2018

(30) Foreign Application Priority Data

Jun. 7, 2017 (CN) ..... 2017 2 0654226 U

(51) Int. Cl.
*A63B 5/11* (2006.01)

(52) U.S. Cl.
CPC ..... *A63B 5/11* (2013.01)

(58) Field of Classification Search
CPC .. A63B 5/00; A63B 5/11; A63B 21/02; A63B 21/00; A63B 21/023; A63B 21/026
See application file for complete search history.

(56) References Cited

U.S. PATENT DOCUMENTS 2,916,746 A * 12/1959 Pease ..... A63B 5/11 182/139
3,891,208 A * 6/1975 Sidlinger ..... A63B 5/11 482/27
3,983,585 A * 10/1976 Sidlinger ..... A63B 5/11 482/27
5,033,169 A * 7/1991 Bindon ..... F16G 11/00 24/115 H
6,129,649 A * 10/2000 Yang ..... A63B 5/11 482/27
6,543,094 B2 * 4/2003 D'Addario ..... F16L 3/233 24/16 PB (Continued)

*Primary Examiner* — Garrett K Atkinson
(74) *Attorney, Agent, or Firm* — Muncy, Geissler, Olds & Lowe, P.C.

(57) ABSTRACT

A trampoline with hanging seat units that allows elastic ropes to be mounted easily, comprises a frame, leg tubes, a bouncing unit, hanging seat units and elastic rope rings. The bouncing unit is hung on the frame and comprises a piece of bouncing cloth and connection belts. The hanging seat units are connected with the connection belts and each comprises a body, a through groove penetrating through the body, a connection body, an extension section, and a clamping and abutting section extending towards the bouncing cloth. The body, the extension section and the clamping and abutting section of each hanging seat unit define a clamping space. Each connection belt penetrates through the corresponding through groove. The bouncing unit and hanging seat units are connected through the elastic rope rings. The ends of each elastic rope ring are arranged in the corresponding connection belt and clamping space in a sleeved mode.

7 Claims, 13 Drawing Sheets

(56) References Cited

U.S. PATENT DOCUMENTS

| | | | | |
|---|---|---|---|---|
| 6,663,538 | B2 * | 12/2003 | Yoon | A63B 5/11 482/27 |
| 7,611,443 | B2 * | 11/2009 | Publicover | A63B 5/11 482/27 |
| 8,038,580 | B2 * | 10/2011 | Pieper Genannt Schmauck | A63B 5/11 482/27 |
| 9,289,637 | B2 * | 3/2016 | Publicover | A63B 5/11 |
| 9,707,426 | B2 * | 7/2017 | Tsai | A63B 5/11 |
| 9,889,328 | B2 * | 2/2018 | Dai | A63B 5/11 |
| 9,993,676 | B2 * | 6/2018 | Guillot | A63B 5/11 |
| 10,124,198 | B2 * | 11/2018 | Haggerty | A63B 5/11 |
| 10,173,090 | B2 * | 1/2019 | Heymans | A63B 5/11 |
| 2007/0012902 | A1 * | 1/2007 | Mo | A63B 71/0054 256/24 |
| 2010/0009812 | A1 * | 1/2010 | Pieper Genannt Schmauck | A63B 5/11 482/27 |
| 2016/0296782 | A1 * | 10/2016 | Dai | A63B 5/11 |

* cited by examiner

TRAMPOLINE WITH HANGING SEAT UNITS THAT ALLOWS ELASTIC ROPES TO BE MOUNTED EASILY

TECHNICAL FIELD

The utility model relates to sports equipment, in particular to a trampoline with hanging seat units that allows elastic ropes to be mounted easily.

DESCRIPTION OF RELATED ART

Please see FIGS. 1-2, a first existing trampoline 1 comprises a frame unit 11, a piece of bouncing cloth 12 arranged in the frame unit 11, a plurality of connection belts 13 arranged on the periphery of the bouncing cloth 12 at intervals, a plurality of fixing components 14 connected with the connection belts 13, and a plurality of elastic ropes 15, and the number of the elastic ropes 15 corresponds to the number of the fixing components 14; the two rope ends on each elastic rope 15 are connected to form a joint 151; during assembling, each elastic rope 15 winds across the frame unit 11, and the two ends on each elastic rope 15 are hung on the corresponding fixing component 14; since the fixing components 14 are used for improving the structural strength, the first existing trampoline has the disadvantages that the fixing components 14 are relatively large and thick, and protrude out of the surface of the bouncing cloth 12, and users can be injured easily; the joints 151 of the elastic ropes 15 are generally provided with sharp corners which cannot be hidden, and consequentially, users can also be injured easily.

Please see FIG. 3, a second existing trampoline 1 is different from the first existing trampoline (shown in FIGS. 1-2) in that each fixing component 14 is provided with two raised columns 141, and the two ends of each elastic rope 15 are knotted into two rings 152 to form two joints 151 for fixing; during mounting, the elastic ropes 15 wind across the frame unit 11 to be hung on one side of the fixing components 14 first, then the two rings 152 of each elastic rope 15 are hung on the corresponding raised columns 141 respectively, and thus fixing is completed; according to the second existing trampoline 1, the two ends of each elastic rope 15 need to be knotted into the rings 152 first, early-stage work is troublesome, and due to the existence of the raised columns 141, the second existing trampoline has the same disadvantage as the first existing trampoline that users can be injured easily.

Please see FIG. 4, a third existing trampoline 1 is different from the second existing trampoline (shown in FIG. 3) in that each fixing component 14 is composed of two grooves 142 instead of the raised columns 141 (shown in FIG. 3), and the two ends of each elastic rope 15 are knotted into two rings 152 to form two joints 151 for fixing; during mounting, the elastic ropes 15 are embedded into the grooves 142 and clamped and limited through the joints 151, and similarly, the third existing trampoline has the same disadvantage with the second existing trampoline that users can be injured easily.

Please see FIG. 5, a fourth existing trampoline 1 is different from the third trampoline (shown in FIG. 4) in that the two ends of each elastic rope 15 are knotted into ring knots 153; during mounting, the elastic ropes 15 are embedded into the grooves 142 and clamped and limited through the ring knots 153, and similarly, the third existing trampoline has the same disadvantage with the third existing trampoline.

Please see FIG. 6, a fifth existing trampoline 1 is different from the second existing trampoline (shown in FIG. 3) in that the number of the elastic ropes 15 is less than the number of the fixing components 14, each fixing component 14 is provided with at least two raised columns 141, and after each elastic rope 15 is hooked and wound on the corresponding raised columns 141 repeatedly and each elastic rope 15 is wound across the frame unit 11, the two rings 152 of each elastic rope 15 are hung on the corresponding raised columns 141, and thus fixing is completed; by adoption of the mounting method, when the trampoline is in use, loosening and falling occur easily, safety cannot be guaranteed in use, and the fifth existing trampoline has the same disadvantage with the second existing trampoline.

BRIEF SUMMARY OF THE UTILITY MODEL

For overcoming at least one disadvantage of the prior art, the utility model aims to provide a trampoline with hanging seat units that allows elastic ropes to be mounted easily.

The trampoline with the hanging seat units that allows elastic ropes to be mounted easily on the utility model comprises a frame, a plurality of leg tubes, a bouncing unit, a plurality of hanging seat units, and a plurality of elastic rope rings.

The frame comprises a space and is in a hollow ring shape.

The leg tubes are arranged at the bottom of the frame at intervals.

The bouncing unit is located in the space and connected and hung on the frame and comprises a piece of bouncing cloth and a plurality of connection belts arranged on the periphery of the bouncing cloth in a surrounding mode at intervals, and each connection belt is in a closed ring shape.

The hanging seat units are connected with the connection belts respectively and each comprise a body, a through groove penetrating through the body in the through groove direction, a connection body connected with the body and adjacent to one end of the bouncing cloth, an extension section extending in the through groove direction from the end, away from the bouncing cloth, of the body, and a clamping and abutting section extending towards the bouncing cloth from the end, away from the body, of the extension section; the body, the extension section and the clamping and abutting section of each hanging seat unit are matched to define a clamping space, and each connection belt penetrates through the corresponding through groove.

Each elastic rope ring is in a closed ring shape and connects the bouncing unit with the corresponding hanging seat unit around the frame, one end of each elastic rope ring is arranged in the corresponding connection belt in a sleeved mode and abuts against the corresponding connection body, and the other end of each elastic rope ring is located in the corresponding clamping space and clamped and fixed to the corresponding extension section and the corresponding clamping and abutting section.

The trampoline of the utility model has the beneficial effects that each hanging seat unit is connected with the corresponding elastic rope ring after being connected with the corresponding connection belt, compared with the way that the two ends of each fixing component are connected with the corresponding elastic ropes respectively in the prior art, each hanging seat unit can be made small in size and extremely thin and cannot protrude out of the surface of the bouncing cloth after being mounted, and thus injuries to users are avoided.

Figure 1:
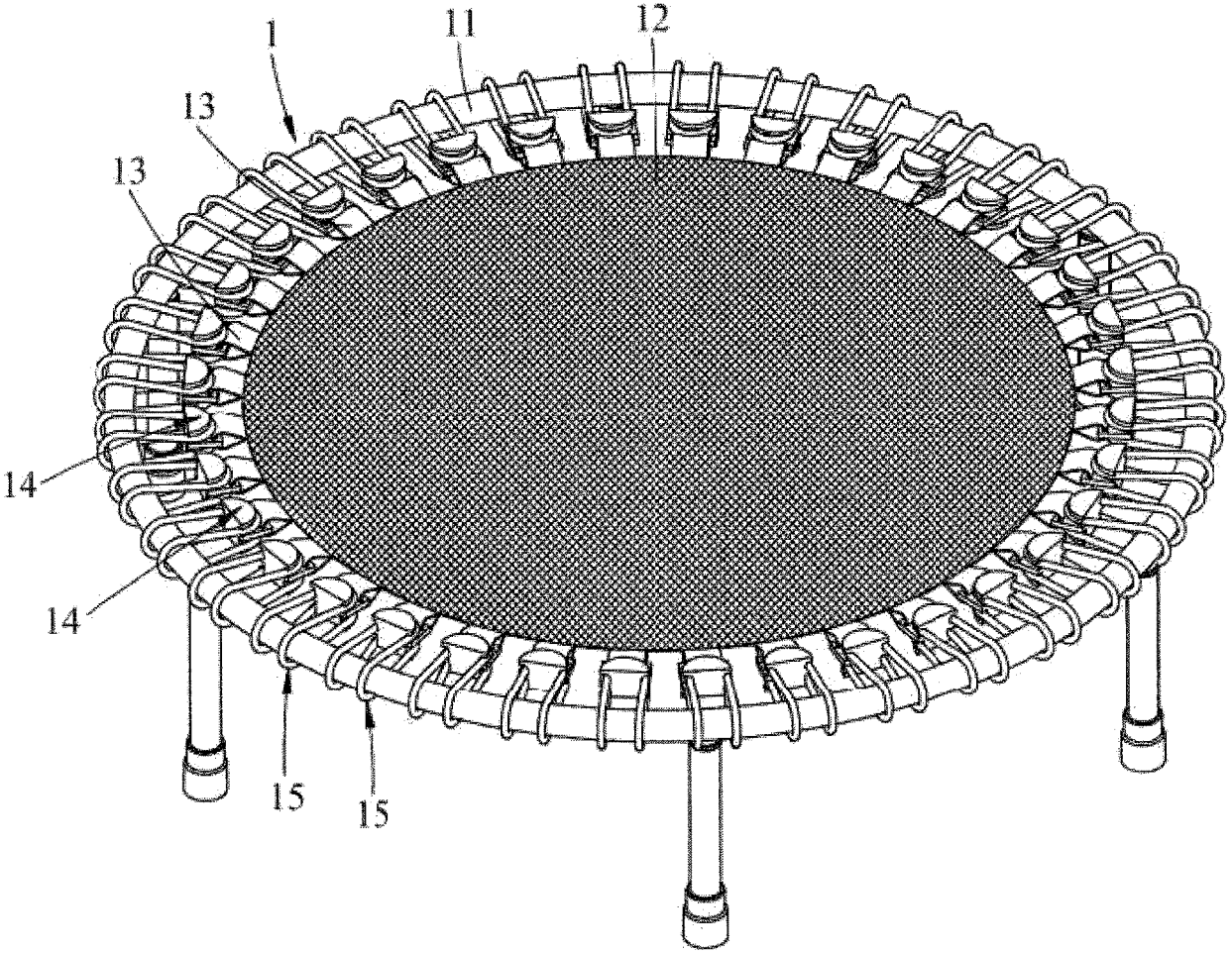
FIG. 1 is a perspective view of a first existing trampoline.
Figure 2:
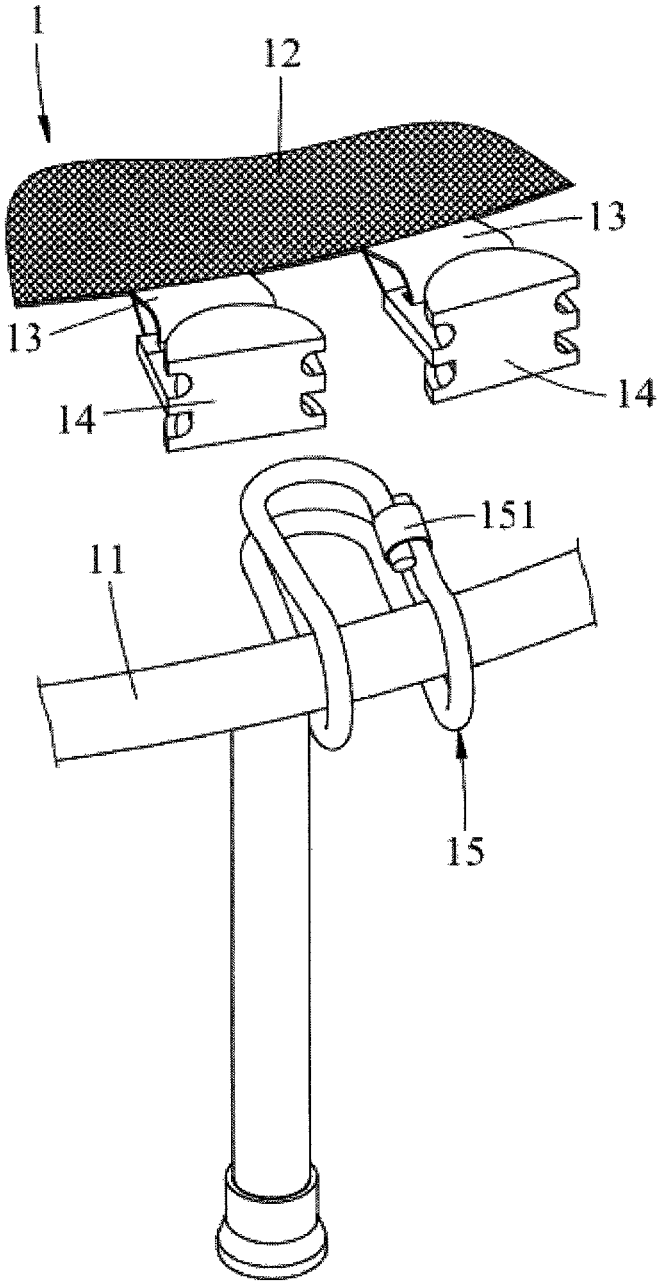
FIG. 2 is an incomplete exploded perspective view of a partial unit from the first existing trampoline.
Figure 3:
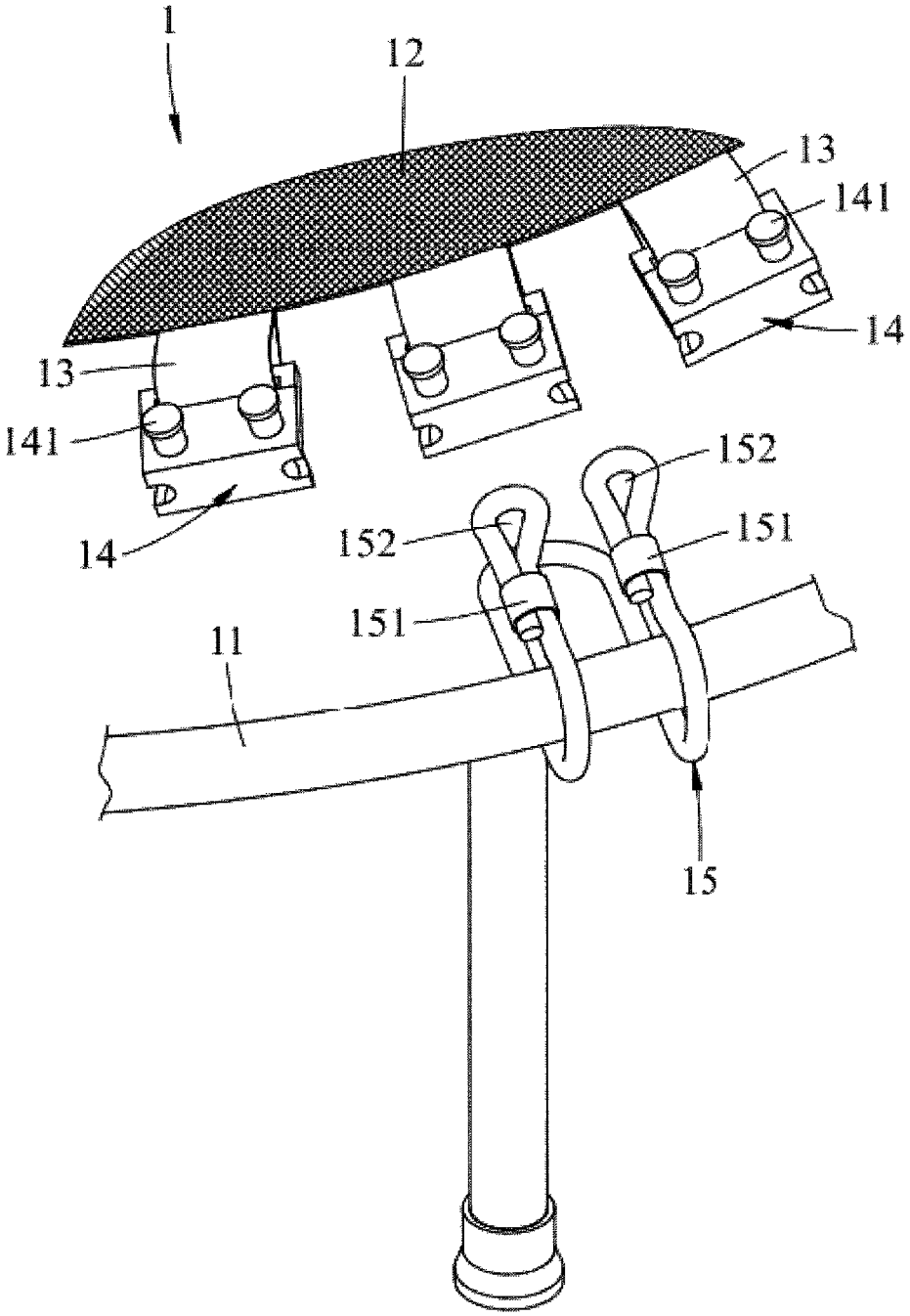
FIG. 3 is an incomplete exploded perspective view of a partial unit from a second existing trampoline.
Figure 4:
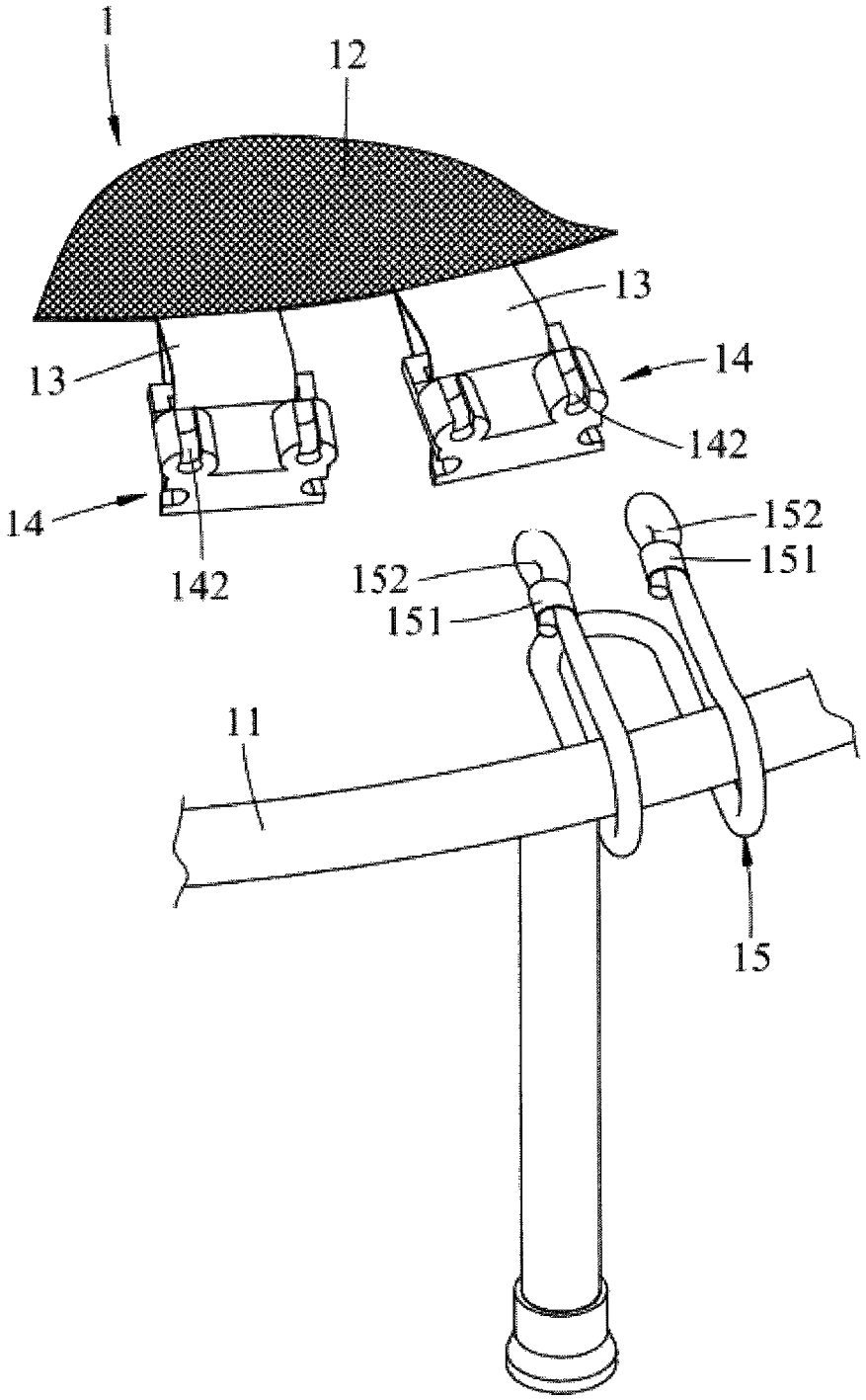
FIG. 4 is an incomplete exploded perspective view of a partial unit from a third existing trampoline.
Figure 5:
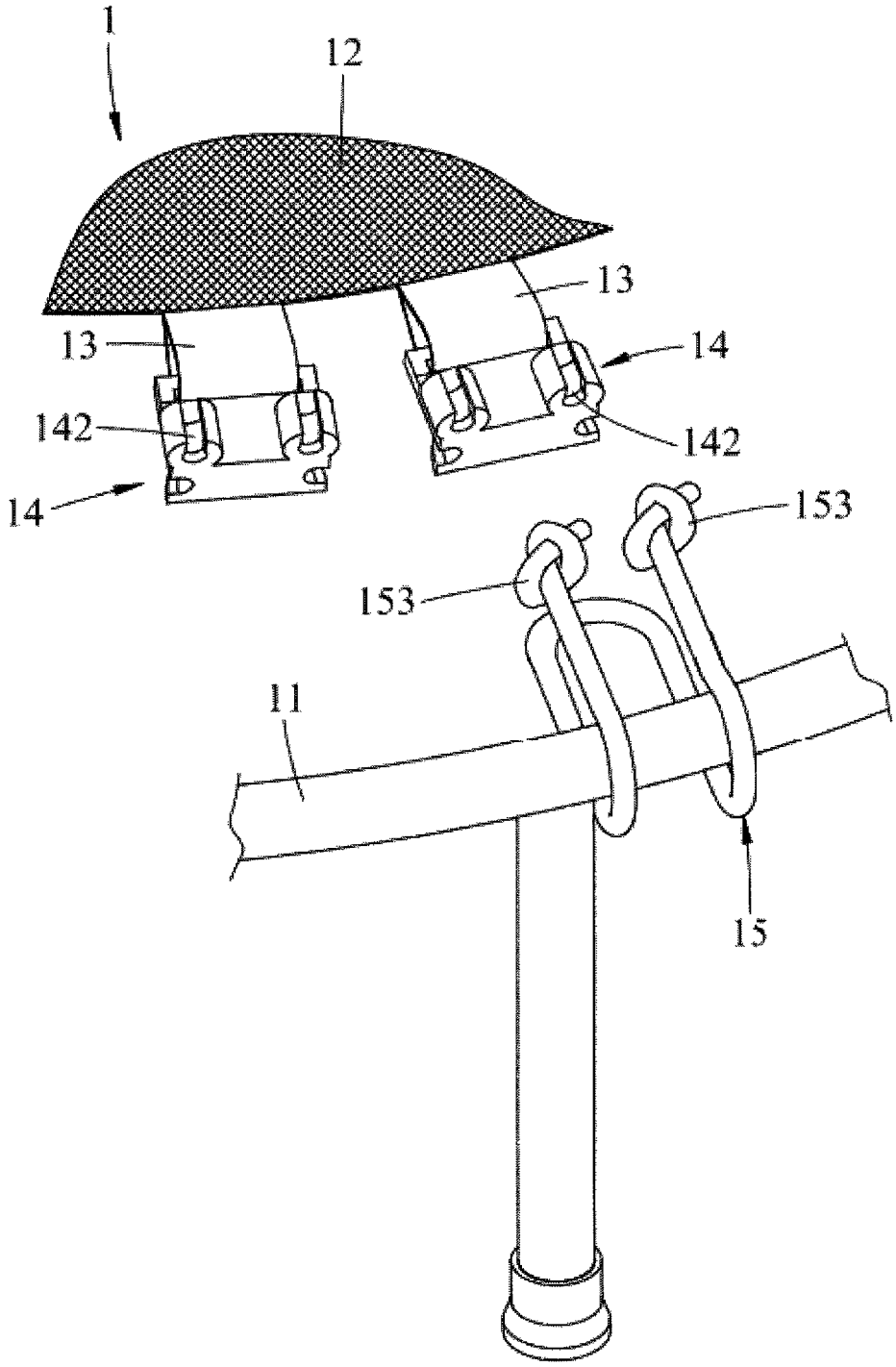
FIG. 5 is an incomplete exploded perspective view of a partial unit from a fourth existing trampoline.
Figure 6:
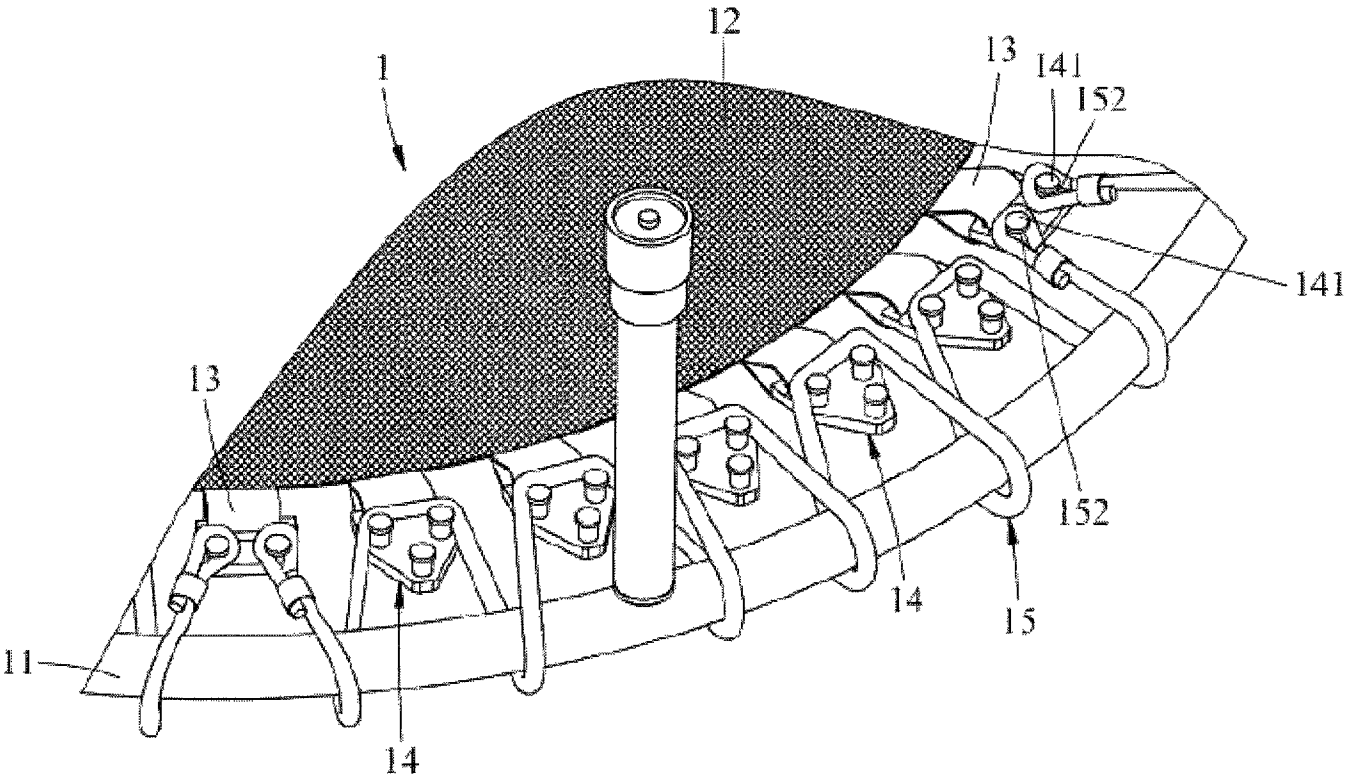
FIG. 6 is an incomplete perspective view of a partial unit from a fifth existing trampoline.

| Description of the Marks: |
|---|
| 1. trampoline |
| 11. frame unit |
| 12. bouncing cloth |
| 13. connection belt |
| 14. fixing component |
| 141. raised column |
| 142. groove |
| 15. elastic rope |
| 151. joint |
| 152. ring |
| 153. ring knot |
| 2. frame |
| 21. space |
| 3. leg tube |
| 4. bouncing unit |
| 41. bouncing cloth |
| 42. connection belt |
| 5. hanging seat unit |
| 51. body |
| 52. through groove |
| 53. connection body |
| 531. first end part |
| 532. second end part |
| 54. extension section |
| 541. concave arc surface |
| 55. clamping and abutting section |
| 56. clamping space |
| 57. through hole |
| 58. limiting component |
| 59. stopper set |
| 591. raised column |
| 592. baffle |
| 6. elastic rope ring |
| 61. joint |
| L. through groove direction |

DETAILED DESCRIPTION OF THE UTILITY MODEL

For a further description of all embodiments, accompanying drawings are provided by the utility model. The accompanying drawings are part of the content disclosed by the utility model and mainly used for illustrating the embodiments and explaining the operating principles of the embodiments in cooperation with the relevant illustration in the description. By referring to the content, those skilled in the field can understand other possible embodiments and advantages of the utility model. Assemblies in the drawings are not drawn in proportion, and similar assembly symbols are generally used for indicating similar assemblies.

A further description of the utility model is given with accompanying drawings and specific embodiments.

Figure 7:
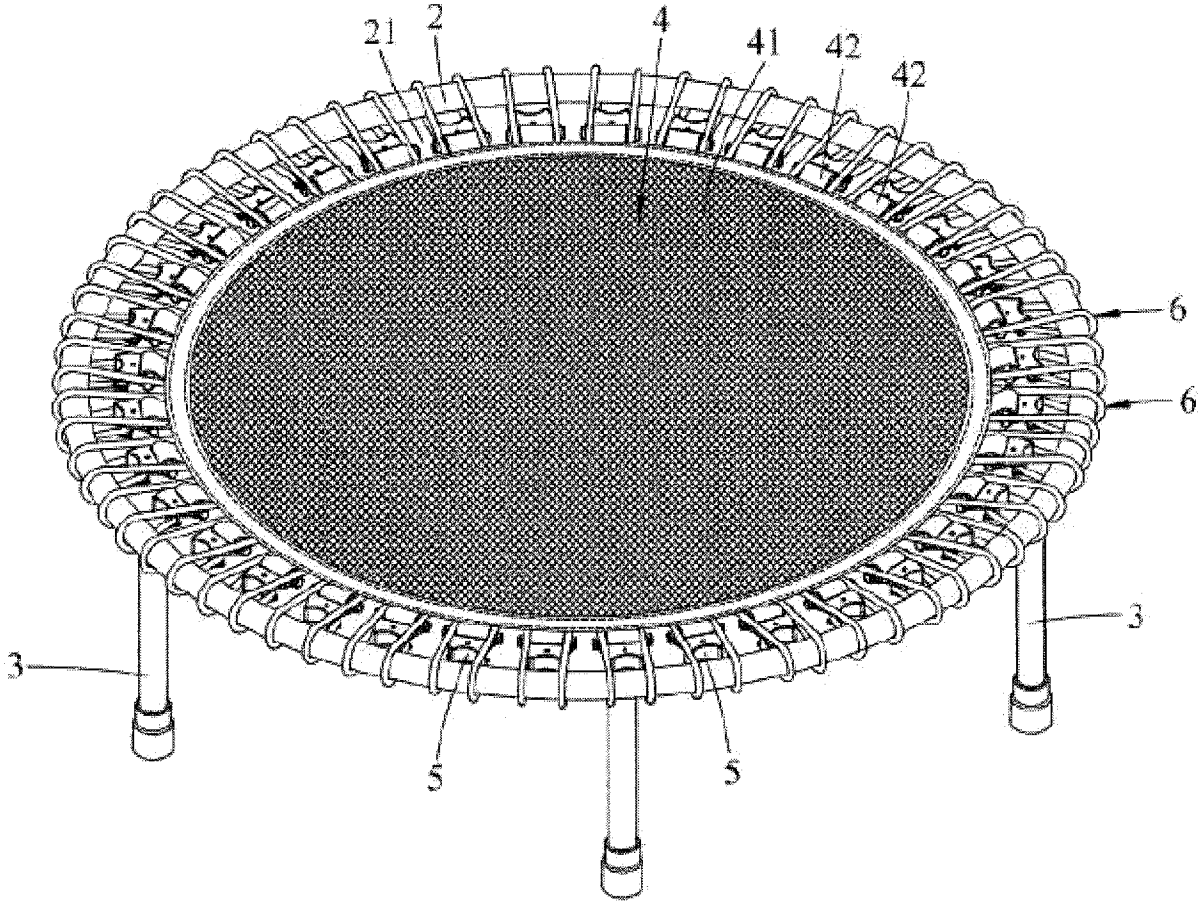
FIG. 7 is a perspective view of a first embodiment of a trampoline with hanging seat units that allows elastic ropes to be mounted easily of the utility model.
Figure 8:
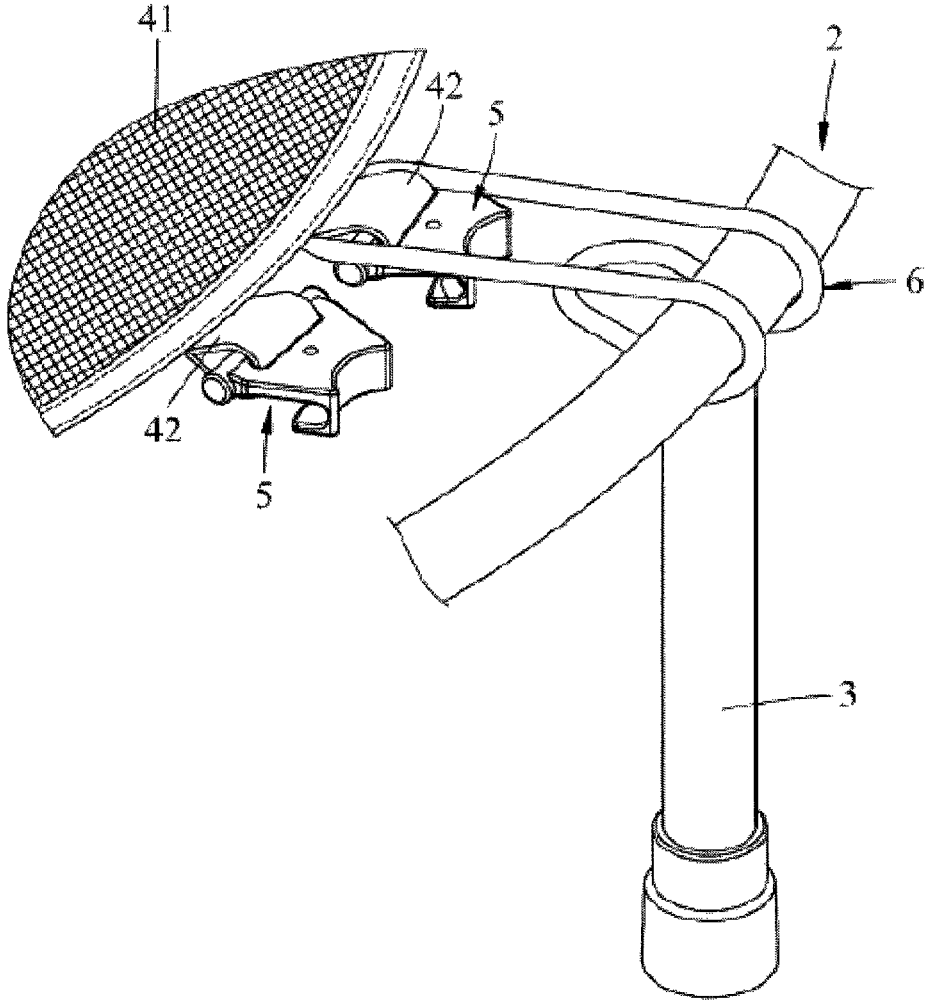
FIG. 8 is an incomplete partial exploded perspective view of the first embodiment.
Figure 9:
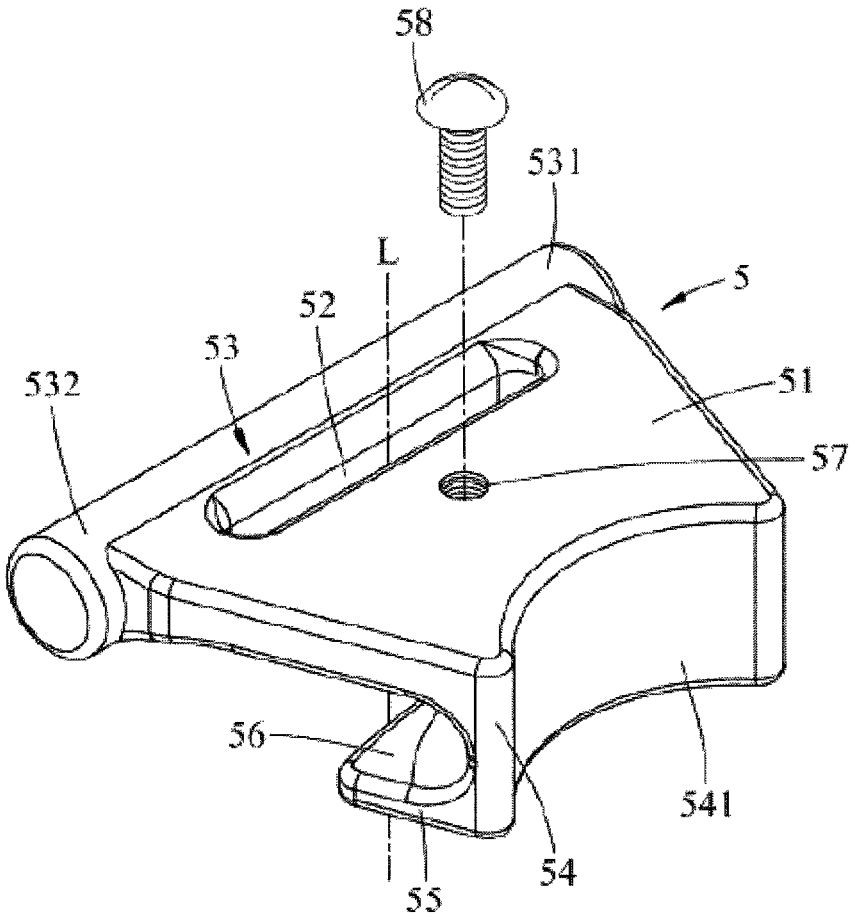
FIG. 9 is a partial enlarged perspective view of the first embodiment.

Please see FIGS. 7-9, the utility model provides a first embodiment of a trampoline with hanging seat units that allows elastic ropes to be mounted easily, and the trampoline with the hanging seat units that allows elastic ropes to be mounted easily comprises a frame 2, a plurality of leg tubes 3, a bouncing unit 4, a plurality of hanging seat units 5, and a plurality of elastic rope rings 6.

The frame 2 comprises a space 21 and is in a hollow ring shape.

The leg tubes 3 are arranged at the bottom of the frame 2 at intervals.

Figure 10:
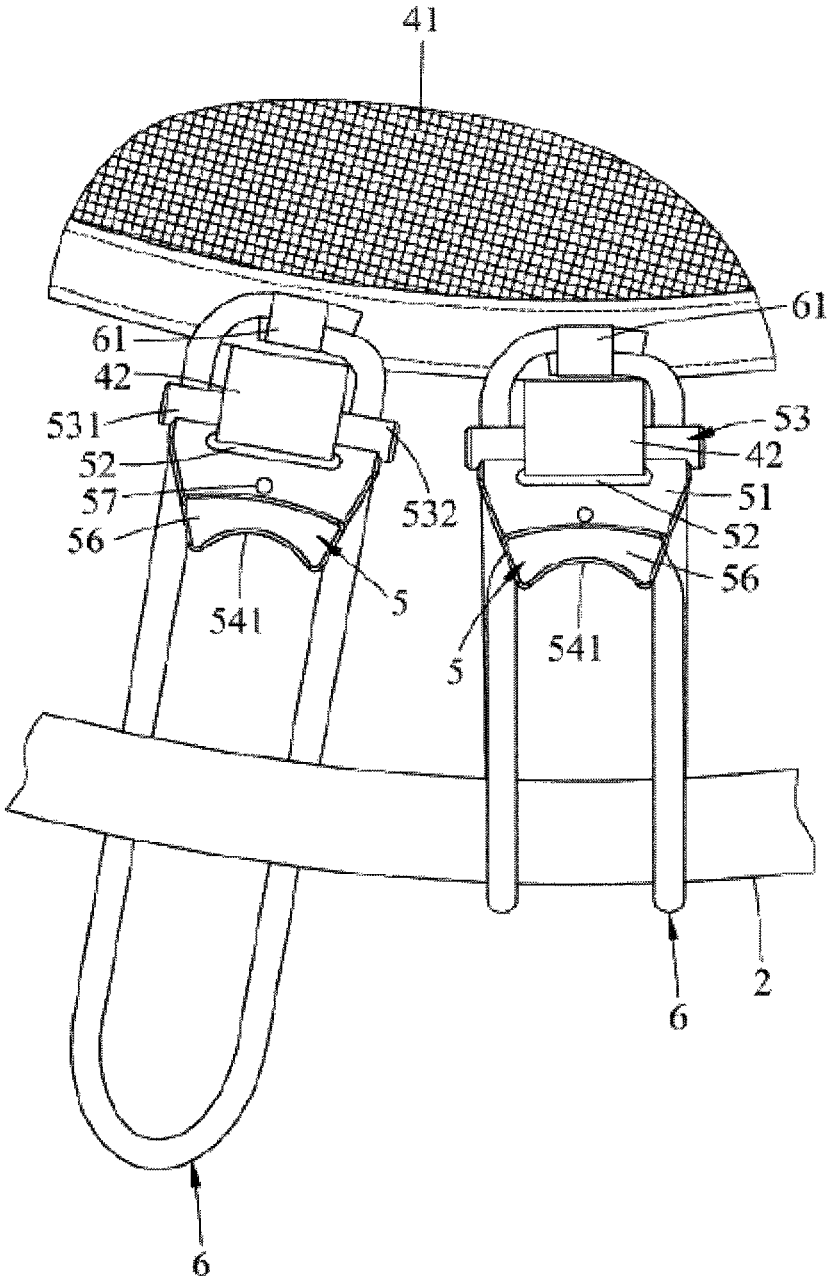
FIG. 10 is a partial enlarged perspective view of the first embodiment.

Please see FIGS. 8-10, the bouncing unit 4 is located in the space 21 and connected and hung on the frame 2 and comprises a piece of bouncing cloth 41 and a plurality of connection belts 42 arranged on the periphery of the bouncing cloth 41 in a surrounding mode at intervals, and each connection belt 42 is in a closed ring shape.

Figure 11:
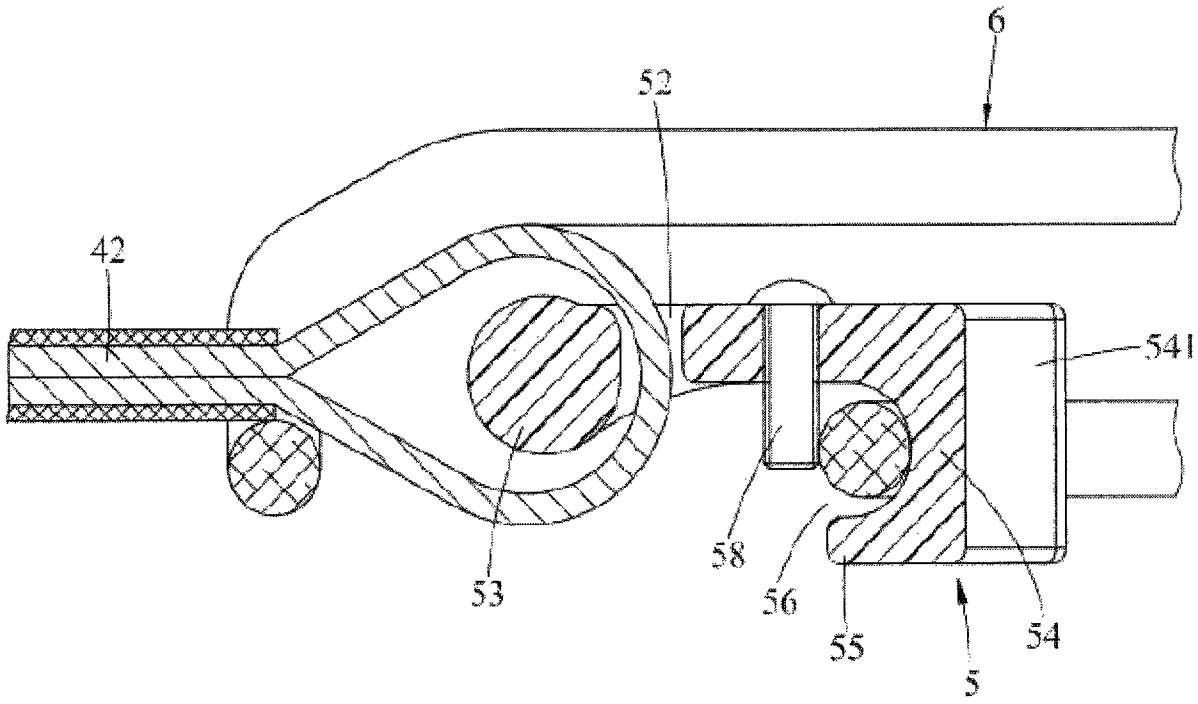
FIG. 11 is an incomplete partial enlarged perspective view of the first embodiment.

The hanging seat units 5 are connected with the connection belts 42 respectively and each comprise a body 51, a through groove 52 penetrating through the body 5 in the through groove direction L, a connection body 53 connected with the body 51 and adjacent to one end of the bouncing cloth 41, an extension section 54 extending in the through groove direction L from the end, away from the bouncing cloth 41, of the body 51, a clamping and abutting section 55 extending towards the bouncing cloth 41 from the end, away from the body 51, of the extension section 54, a clamping space 56 defined by the body 51, the extension section 54 and the clamping and abutting section 55 in cooperation, a through hole 57 penetrating through the body 51 in the through groove direction L, and a limiting component 58 penetrating through the through hole 57 to clamp and limit the corresponding elastic rope ring 6 in the clamping space 56 (as is shown in FIG. 11), and each connection belt 42 penetrates through the corresponding through groove 52 and is tied on the corresponding connection body 53 in a sleeving mode.

The connection body 53 of each hanging seat unit 5 is provided with a first end part 531 and a second end part 532 which are formed at the two ends respectively, and the first end part 531 and the second end part 532 both stretch out of the body 51 and used for stopping and limiting the corresponding elastic rope ring 6.

The side, away from the bouncing unit 4, of the extension section 54 of each hanging seat unit 5 is provided with a concave arc surface 541, and the curvature center of the concave arc surface 541 is away from the bouncing unit 4.

Each elastic rope ring 6 is in a closed ring shape and connects the bouncing unit 4 with the corresponding hanging seat unit 5 around the frame 2; one end of each elastic rope ring 6 is arranged in the corresponding connection belt 42 in a sleeved mode and abuts against the corresponding connection body 53, and the other end of each elastic rope ring 6 is clamped and fixed to the corresponding extension section 54 and the corresponding clamping and abutting section 55 and clamped and limited in the corresponding clamping space 56 through the corresponding limiting component 58 (as is shown in FIG. 11). Each elastic rope ring 6 is in a closed ring shape, during manufacturing, the two tail ends of each elastic rope are connected, so that a protruding joint 61 is formed at the junction of each elastic rope ring 6.

When the bouncing unit 4 is about to be mounted on the frame 2, one end of one elastic rope ring 6 is tied on the connection belt 42 located between one hanging seat unit 5 and the bouncing cloth 41 in a sleeving mode from bottom to top firstly, and then the elastic rope ring 6 is stretched outwards, winds across the frame 2 from top to bottom and draws close to the space below the hanging seat unit 5, wherein during stretching, it should be noticed that the end, close to the bouncing cloth 41, of the elastic rope ring 6 is located between the first end part 531 and the second end part 532, then the end, away from the bouncing cloth 41, of the elastic rope ring 6 is arranged in the corresponding clamping space 56 in a sleeved mode and tied on the corresponding extension section 54 and the corresponding clamping and abutting section 55 in a sleeving mode, finally one limiting component 58 is made to penetrate through the corresponding through hole 57, the end of the elastic rope ring 6 away from the bouncing cloth 41 is limited and clamped in the corresponding clamping space 56 (shown in FIG. 11), and thus the elastic rope ring 6 is mounted; then the above steps are repeated until all the elastic rope rings 6 are mounted, and thus mounting is completed.

What should be mentioned is that the outward-stretching motion is conducted after the joint 61 formed on each elastic rope ring 6 is arranged below the bouncing cloth 41 during mounting (as is shown in FIG. 10) so that the joints 61 can be hidden below the bouncing cloth 41, and injuries to users are avoided when the trampoline is used.

Figure 12:
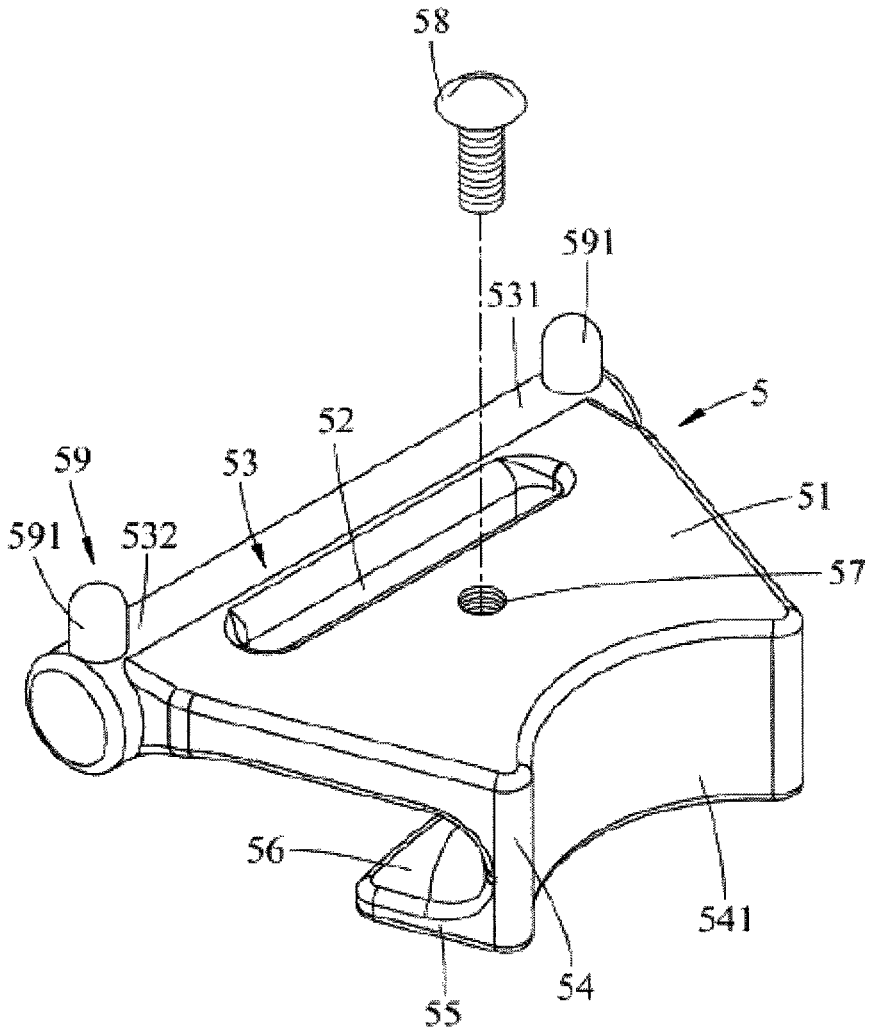
FIG. 12 is a partial enlarged perspective view of a second embodiment of the trampoline with the hanging seat units that allows elastic ropes to be mounted easily of the utility model.

Please see FIG. 12, a second embodiment of the utility model is different from the first embodiment in that each hanging seat unit 5 further comprises a stopper set 59 which is formed on the corresponding connection body 53 and used for stopping and limiting the corresponding elastic rope ring 6; each stopper set 59 is composed of two raised columns 591 which extend in the through groove direction L, wherein the raised columns 591 are adjacent to the first end part 531 and the second end part 532 respectively, and the extension direction of the raised columns 591 is opposite to the extension direction of the extension section 54. During mounting, the above mounting method is adopted, however, it should be noticed that in the stretching process, the end, close to the bouncing cloth 41, of each elastic rope ring 6 is located between the corresponding raised columns 591, and thus the effect of limiting and clamping the elastic rope rings 6 can also be achieved.

Figure 13:
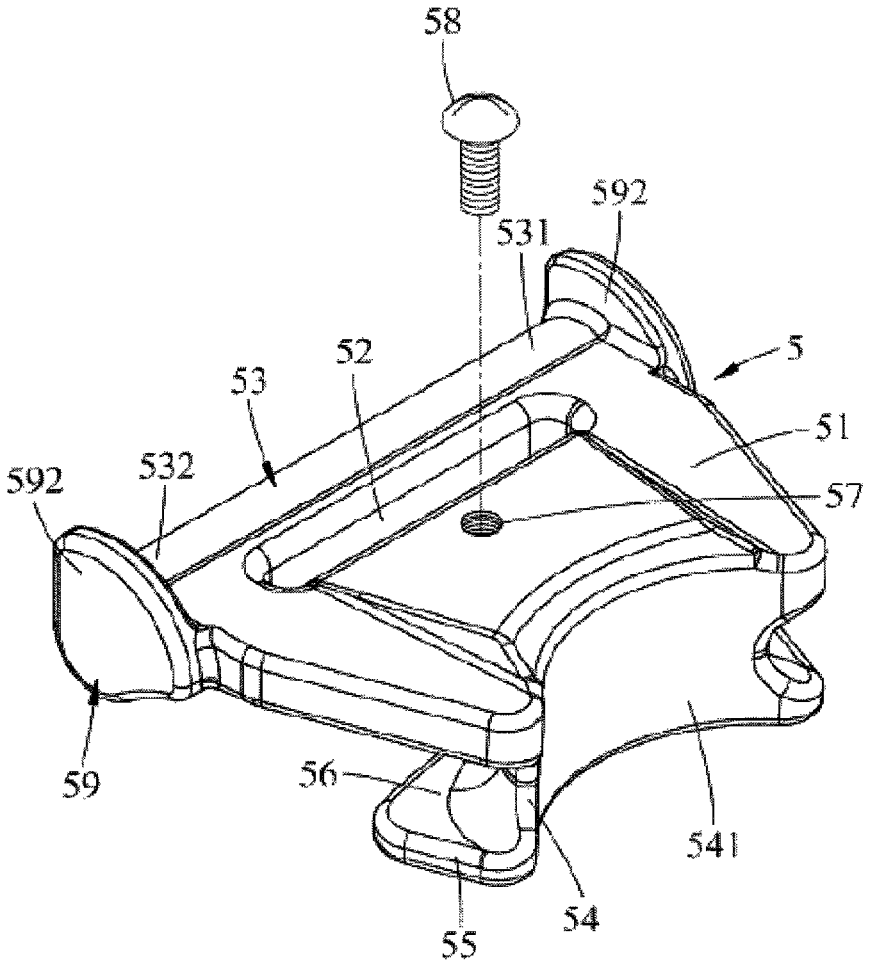
FIG. 13 is a partial enlarged perspective view of a third embodiment of the trampoline with the hanging seat units that allows elastic ropes to be mounted easily of the utility model.

Please see FIG. 13, a third embodiment of the utility model is different from the second embodiment in that each stopper set 59 is composed of two baffles 592 which extend outwards from the first end part 531 and the second end part 532 respectively, similarly, it also should be noticed that in the stretching process for mounting, the end, adjacent to the bouncing cloth 41, of each elastic rope ring 6 is located between the corresponding baffles 592, and thus the effect of limiting and clamping the elastic rope rings 6 can also be achieved.

In conclusion, the trampoline with the hanging seat units that allows elastic ropes to be mounted easily of the utility model has the following advantages that:

Firstly, both ends of each elastic rope 15 mentioned in the prior art are connected to the same fixing component 15, and each fixing component 15 can be large in size and extremely thick; however, each hanging seat unit 5 in the utility model is only connected with one end of the corresponding elastic rope ring 6, and thus each hanging seat unit 5 small in size and extremely thin and cannot protrude out of the surface of the bouncing cloth 41 after being mounted, and injuries to users are avoided.

Secondly, in the process of manufacturing the elastic rope rings 6, only the two ends of each elastic rope need to be connected to form one joint 61, and compared with the prior art, operation is easy and convenient; during mounting, outward-stretching motion is conducted after each joint 61 is arranged below the bouncing cloth 41, so that the joints 61 are hidden below the bouncing cloth 41, attractiveness is guaranteed, and injuries to users are avoided when the trampoline is used.

Thirdly, through the design of the first end part 531 and the second end part 532 of each connection body 53 and the raised columns 591 or the baffles 592 of each stopper set 59, the end, adjacent to the bouncing cloth 41, of each elastic rope ring 6 can be clamped and limited and be prevented from disengaging from the corresponding connection body 53, and thus the safety in the using process is improved.

Fourthly, through the limiting components 58 which penetrate through the corresponding through holes 57 to clamp and limit the corresponding elastic rope rings 6 in the clamping spaces 56, the end, away from the bouncing cloth 41, of each elastic rope ring 6 can be clamped and limited and be prevented from disengaging from the clamping space 56, so that the safety in the using process is improved, and the purposes of the utility model can be realized truly.

In conclusion, the foregoing descriptions are only embodiments of the utility model, however, the scope of the utility mode is not limited to the foregoing description, and all simple equivalent changes and modifications made according to the scope of the claims and the content of the description of the utility model are still within the scope of the utility model.

What is claimed is:

1. A trampoline with hanging seat units that allows elastic ropes to be mounted easily, comprising:

a frame, wherein the frame comprises a space and is in a hollow ring shape;

a plurality of leg tubes, wherein the leg tubes are arranged at the bottom of the frame at intervals;

a bouncing unit, wherein the bouncing unit is located in the space and connected and hung on the frame and comprises a piece of bouncing cloth and a plurality of connection belts arranged on the periphery of the bouncing cloth in a surrounding mode at intervals, and each connection belt is in a closed ring shape;

a plurality of hanging seat units, wherein the hanging seat units are connected with the connection belts and each comprise a body, a through groove penetrating through the body in the through groove direction, a connection body connected with the body and adjacent to the bouncing cloth, an extension section extending in the through groove direction from the end of the body away from the bouncing cloth, and a clamping and abutting section extending towards the bouncing cloth from the end of the extension section away from the body; the body, the extension section, and the clamping and abutting section of each hanging seat unit are matched to define a clamping space, and each connection belt penetrates through the corresponding through groove; a plurality of elastic rope rings, wherein each elastic rope ring is in a closed ring shape and connects the bouncing unit with the corresponding hanging seat unit around the frame, one end of each elastic rope ring is arranged in the corresponding connection belt in a sleeved mode and abuts against the corresponding connection body, and the other end of each elastic rope ring is located in the corresponding clamping space and clamped and fixed to the corresponding extension section and the corresponding clamping and abutting section.

2. The trampoline with the hanging seat units that allows elastic ropes to be mounted easily according to claim 1, wherein each connection body is provided with a first end part and a second end part which are formed at the two ends, and the first end part and the second end part both stretch out of the corresponding body.

3. The trampoline with the hanging seat units that allows elastic ropes to be mounted easily according to claim 2, wherein each hanging seat unit further comprises a stopper set formed on the corresponding connection body and is used for stopping and limiting the corresponding elastic rope ring.

4. The trampoline with the hanging seat units that allows elastic ropes to be mounted easily according to claim 3, wherein the stopper set of each hanging seat unit is composed of two baffles extending outwards from the first end part and the second end part respectively.

5. The trampoline with the hanging seat units that allows elastic ropes to be mounted easily according to claim 3, wherein the stopper set of each hanging seat unit is composed of two raised columns which extend in the through groove direction and are adjacent to the first end part and the second end part respectively.

6. The trampoline with the hanging seat units that allows elastic ropes to be mounted easily according to claim 1, wherein each hanging seat unit further comprises a through hole which penetrates through the corresponding body in the through groove direction, and a limiting component which penetrates through the through hole and is used for clamping and limiting the other end of the corresponding elastic rope ring in the corresponding clamping space.

7. The trampoline with the hanging seat units that allows elastic ropes to be mounted easily according to claim 1, wherein the side, away from the bouncing unit, of the extension section of each hanging seat unit is provided with a concave arc surface, and the curvature center of the concave arc surface is away from the bouncing unit.

* * * * *